US006746265B2

(12) United States Patent
Shirai et al.

(10) Patent No.: US 6,746,265 B2
(45) Date of Patent: Jun. 8, 2004

(54) ELECTRICAL CONNECTOR ASSEMBLY AND MALE CONNECTOR USED IN THE SAME

(75) Inventors: Hiroshi Shirai, Saitama (JP); Katsuhiko Kobayashi, Yamanashi (JP); Naotaka Sasame, Tokyo (JP); Takaki Naito, Kanagawa (JP); Doron Lapidot, Tokyo (JP)

(73) Assignee: Tyco Electronics. AMP, K.K., Kanagawa (JP)

( * ) Notice: Subject to any disclaimer, the term of this patent is extended or adjusted under 35 U.S.C. 154(b) by 0 days.

(21) Appl. No.: 09/966,238

(22) Filed: Sep. 28, 2001

(65) Prior Publication Data

US 2002/0039860 A1 Apr. 4, 2002

(30) Foreign Application Priority Data

Oct. 2, 2000 (JP) ..... 2000-302614

(51) Int. Cl.[7] ..... H01R 13/627
(52) U.S. Cl. ..... 439/352; 439/357
(58) Field of Search ..... 439/607–610, 439/357, 350, 358, 465

(56) References Cited

U.S. PATENT DOCUMENTS 5,222,909 A * 6/1993 Nomura et al. ..... 439/607
5,288,247 A 2/1994 Kaufman ..... 439/607
5,545,052 A * 8/1996 Hirai ..... 439/354
5,564,939 A * 10/1996 Maitani et al. ..... 439/352
5,634,809 A * 6/1997 Hirai ..... 439/352
5,660,558 A * 8/1997 Osanai et al. ..... 439/353
5,951,316 A * 9/1999 Kawano et al. ..... 439/352
6,036,544 A * 3/2000 Brunker et al. ..... 439/607
6,056,578 A * 5/2000 Lin ..... 439/358
6,287,146 B1 * 9/2001 Avery et al. ..... 439/607
6,431,887 B1 * 8/2002 Yeomans et al. ..... 439/108

FOREIGN PATENT DOCUMENTS

| | | | |
|---|---|---|---|
| EP | 0 562 311 A2 | 9/1993 | |
| EP | 0 600 120 A1 | 6/1994 | |
| EP | 0 736 936 A2 | 10/1996 | |
| JP | 63-172071 | 11/1988 | ..... H01R/13/648 |
| JP | 3-116674 | 12/1991 | ..... H01R/13/639 |
| JP | 2542233 | 7/1997 | ..... H01R/17/04 |

* cited by examiner

*Primary Examiner*—Hien Vu

(57) ABSTRACT

The male connector 1 has a metal shielding shell 4 that accommodates a housing 2 and a synthetic resin enclosure 8 that covers approximately the rear half of this shielding shell 4. Fastening parts 40 and protruding parts 42 are formed by stamping in the upper-side shell half-body 4*a*. A metal latching arm 44 which is formed with the approximate shape of a shallow inverted V, and which has an engaging part 54, is disposed between these fastening parts 40 and protruding parts 42. The latching arm 44 can be pressed by means of a finger-catch part 68. This configuration obtains the desired shielding performance while maintaining a compact size in a shielded electrical connector assembly.

10 Claims, 6 Drawing Sheets

ELECTRICAL CONNECTOR ASSEMBLY AND MALE CONNECTOR USED IN THE SAME

FIELD OF THE INVENTION

The present invention relates to an electrical connector assembly. More specifically, the present invention relates to a shielded electrical connector assembly which is used for high-speed digital image transmission between liquid crystal monitors and personal computer main bodies (or multimedia relay boxes), or for high-speed digital image transmission between copying machines and servers.

BACKGROUND

Conventionally, in order to improve noise resistance in high-speed signal transmission, shielding members are generally provided on housings in which signal contacts are provided, as is shown in Japanese Utility Model Registration No. 2542233. Electrical contact terminals are positioned inside a socket housing to form a socket connector. This connector is constructed so that this socket connector and another plug connector of similar construction are engaged and locked to each other by means of a locking part. The locking part is disposed in a location that is separated from the shielding shell.

Generally, in cases where shielding shells are caused to contact each other, electrical contact parts are disposed on the shielding shells at intervals that are equal to or less than one quarter of the wavelength of the signals transmitted, in order to ensure that the electrical connection is secure and effective. For example, a construction in which a plurality of ground indents are formed at specified intervals around the engaging parts of a shielding shell part is disclosed in Japanese Utility Model Application Kokai No. S63-172071. Furthermore, a construction in which a plurality of spring contact fingers are formed at specified intervals on the inside of a conductive shroud is disclosed in U.S. Pat. No. 5,288,247. These contact parts make electrical contact with the shielding shell of the engaged male connector, so that integral electromagnetic shielding is accomplished. Except in cases where the engagement of the two connectors is maintained by frictional engagement, the locking part is disposed in a separate position so that it does not affect the electrical contact parts of these shielding shells.

Furthermore, a locking device in which a plate member is bent outward so that an operating part that is pressed by the fingers is formed on the connector cover is disclosed in Japanese Utility Model Application Kokai No. H3-116674. In the case of this operating part, the plate member is bent in an approximate C shape and caused to protrude from the surface of the connector cover.

In cases where the locking part is installed in a position that is separated from the shielding shell, the problem of an increase in the size of the connector itself arises. Especially in the case of compact devices such as notebook-type personal computers, the space of the connector is limited, so that any extra space required by the shielding can create a major problem. Furthermore, if a construction in which the locking part and shielding shells interfere with each other is adopted in order to reduce the size of the connector, it becomes difficult to maintain the integrity of the contact parts that cause the shielding shells to contact each other at a specified spacing so that the desired shielding performance can be obtained. In the case of the connector disclosed in Japanese Utility Model Application Kokai No. H3-116674, the operating part protrudes, so that it is difficult to use this connector in places where the installation space is restricted.

The present invention was devised in light of the above-mentioned points. The object of the present invention is to provide an electrical connector assembly which makes it possible to obtain the desired shielding performance while being compact in size.

SUMMARY OF THE INVENTION

The electrical connector assembly of the present invention has a male connector and a female connector, each of which has an insulating housing that holds contacts, and a shielding shell that is externally mounted on the respective insulating housing. The connectors are engaged with each other and locked to each other. The male connector has a latching arm with a first engaging part. This engaging part has electrical continuity with the shielding shell of the male connector. The female connector has another or second engaging part which has electrical continuity with the shielding shell of the female connector, and which engages with the first engaging part. Both of the shielding shells respectively have a plurality of contact parts which are disposed in the direction perpendicular to the direction of insertion of the connectors, and which contact each other when the connectors are engaged with each other. The first engaging part and the second engaging part act in conjunction to form a portion of the contact parts, so that the plurality of contact parts as a whole are disposed at equal intervals in the direction perpendicular to the direction of insertion of the connectors. The term "equal intervals" also includes cases in which there is some variation in dimensions, in addition to cases of completely equal intervals.

In one embodiment, the contact parts of the female connector may be spring contact parts that protrude from the shielding shell of the female connector toward the shielding shell of the male connector. The contact parts of the male connector may be contact surfaces of the shielding shell of the male connector that contact the spring contact parts.

The latching arm may be made of metal with the first engaging part being an engaging hole that is formed in the latching arm. The second engaging part may be an anchoring projection which is caused to protrude from the shielding shell of the female connector, and which engages with the engaging hole.

The male connector of the present invention is equipped with an insulating housing that holds contacts, a shielding shell that is externally mounted on this insulating housing, and a locking part that is disposed on the outside of this shielding shell and that engages with a mating connector. The locking part has a metal latching arm with the approximate shape of a shallow inverted V. A front end of the arm is fastened to the tip end portion of the shielding shell, and a rear end is held so that the rear end can slide on the surface of the shielding shell. The latching arm has an engaging part which is located near the front end part of the latching arm. The engaging part engages with a mating engaging part of the mating connector. A pressing part is located on the rear part of the latching arm.

In one embodiment, the engaging part may be an engaging hole formed in the forward-facing surface of the latching arm that has the approximate shape of a shallow inverted V. The pressing part may be the rearward-facing surface of the latching arm that is inclined toward the rear. The term "approximate shape of a shallow inverted V" refers to the approximate shape of a peak with a relatively low height.

A covering enclosure may be formed on the outside of the shielding shell with the tip end portion of the shielding shell exposed. This enclosure may have a finger-catch part on the rearward-facing surface that makes it possible to push this rearward-facing surface.

In the electrical connector assembly of the present invention, the male connector has a latching arm which has a first engaging part, and this first engaging part has electrical continuity with the shielding shell of the male connector. Furthermore, the female connector has a second engaging part which has electrical continuity with the shielding shell of the female connector, and which engages with the first engaging part of the male connector. Both shielding shells have a plurality of contact parts which are disposed in the direction perpendicular to the direction of insertion of the connectors, and which contact each other when the connectors are engaged with each other, with the first engaging part and the second engaging part acting in conjunction to form a portion of the contact parts. The plurality of contact parts as a whole are disposed at equal intervals in the direction perpendicular to the direction of insertion of the connectors. Accordingly, an electrical connector assembly can be obtained which has the desired shielding performance, i.e. noise resistance, while being compact in size.

The contact parts of the female connector can be spring contact parts that are caused to protrude from the shielding shell of the female connector toward the shielding shell of the male connector. In such embodiment, the contact parts of the male connector are contact surfaces of the shielding shell of the male connector that contact the spring contact parts of the female connector. The electrical connection of the two shielding shells of this configuration can be made much more secure, and the reliability of the noise resistance can be improved.

In an embodiment where [a] the latching arm is made of metal, [b] the first engaging part of the latching arm is an engaging hole that is formed in the latching arm, and [c] the second engaging part of the female connector is an anchoring projection which is caused to protrude from the shielding shell of the female connector, and which engages with the engaging hole of the latching arm, the latching arm is a plate-form metal part with a simple shape that has no projections. Accordingly, an electrical connector assembly which has a strong and compact latching arm can be obtained.

The male connector of the present invention is equipped with an insulating housing, a shielding shell that is externally mounted on the insulating housing, and a locking part that is disposed on the outside of the shielding shell. The locking part has a metal latching arm with the approximate shape of a shallow inverted V. The front end of the latching arm is fastened to the tip end portion of the shielding shell, and the rear end is held so that this rear end can slide on the surface of the shielding shell. The latching arm has an engaging part which is located near the front end part of the latching arm, and which engages with an engaging part of the other connector. A pressing part is located on the rear part of the latching arm. Accordingly, it is possible to obtain a male connector which has the desired shielding performance (noise resistance) while being compact in size.

In an embodiment where the engaging part of the latching arm is an engaging hole formed in the forward-facing surface of the latching arm, which has the approximate shape of a shallow inverted V, and the pressing part is the rearward-facing surface of the latching arm, which is inclined toward the rear, a compact male connector which has a strong and simply constructed latching arm can be obtained. Furthermore, in a case where a covering enclosure is formed on the outside of the shielding shell with the tip end portion of the shielding shell exposed, and the enclosure has a finger-catch part on the rearward-facing surface that makes it possible to push this rearward-facing surface, a male connector with good operating characteristics can be obtained.

BRIEF DESCRIPTION OF THE DRAWINGS

FIG. 4 shows the latching arm used in the male connector.

DETAILED DESCRIPTION OF THE EMBODIMENT DISCLOSED

Figure 1:
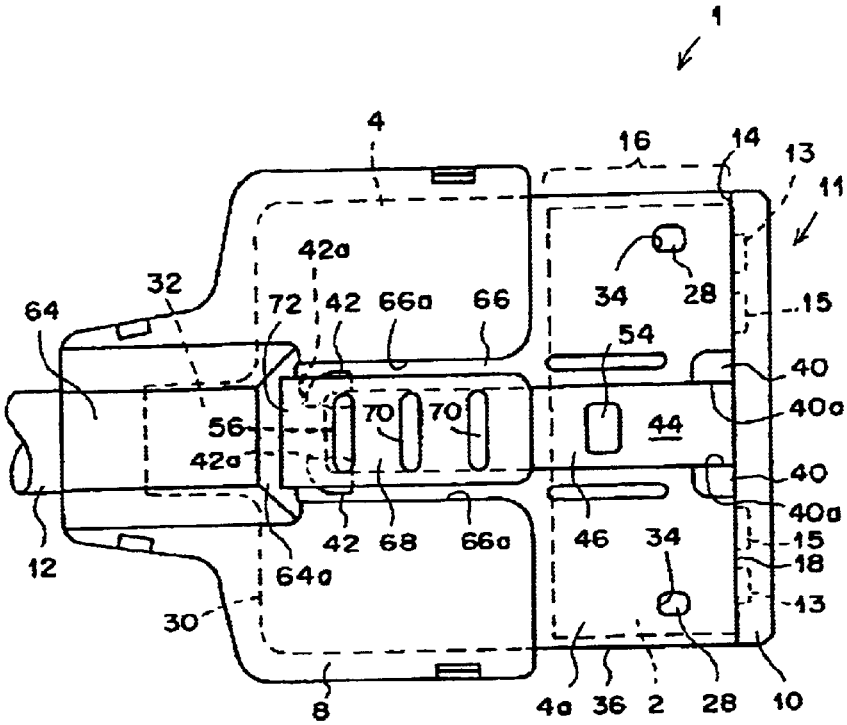
FIG. 1 is a plan view of the male connector of the present invention.
Figure 2:
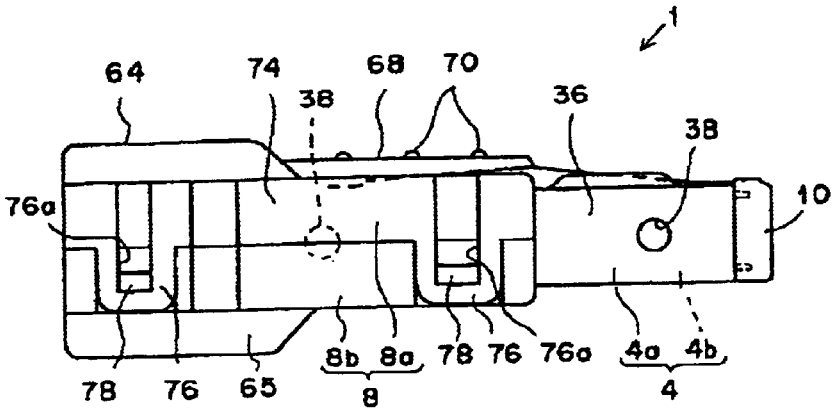
FIG. 2 is a side view of the male connector shown in FIG. 1.
Figure 3:
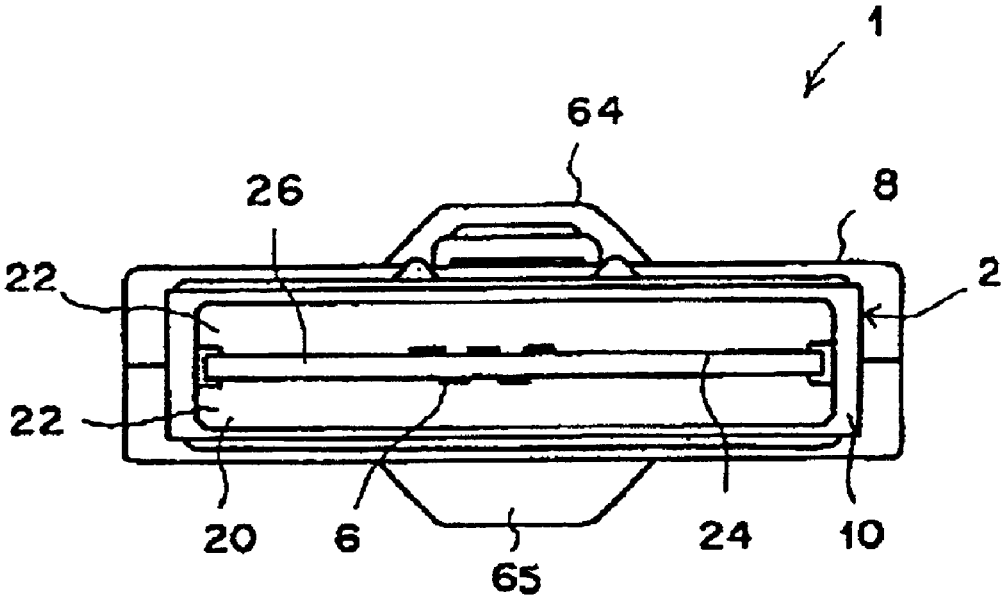
FIG. 3 is a front view of the male connector shown in FIG. 1.
Figure 4A:
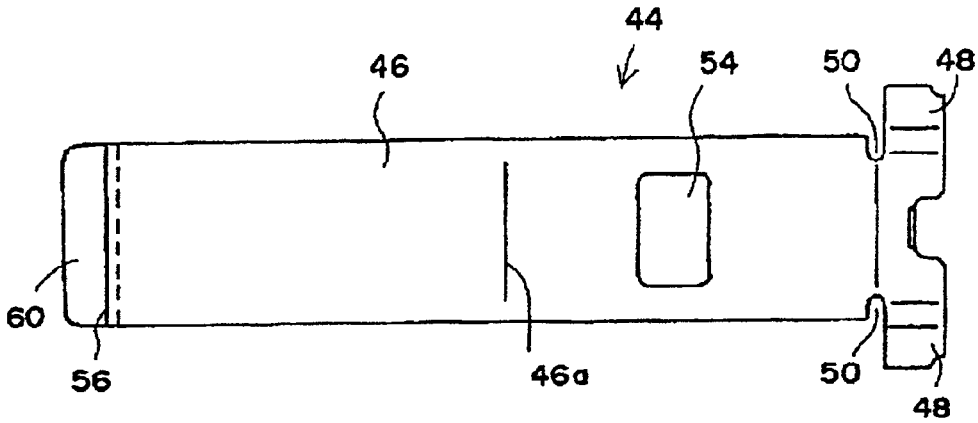
FIG. 4(A) is a plan view.
Figure 4B:
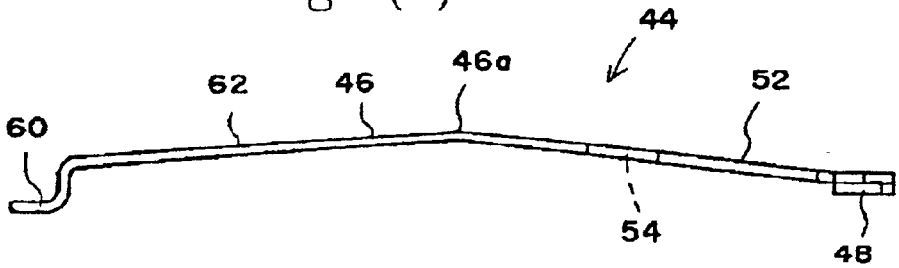
FIG. 4(B) is a side view.
Figure 4C:
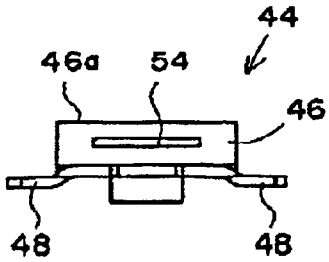
FIG. 4(C) is a front view.

Various configurations of the electrical connector assembly (hereafter referred to simply as an "assembly") of the present invention will be described in detail with reference to the attached figures. FIG. 1 is a plan view of the male connector of the present invention, FIG. 2 is a side view of the male connector shown in FIG. 1, and FIG. 3 is a front view of the male connector shown in FIG. 1. FIG. 4 shows the latching arm used in this male connector. FIG. 4(A) is a plan view, FIG. 4(B) is a side view, and FIG. 4(C) is a front view.

The following description will refer to FIGS. 1 through 4. As is shown in FIG. 1, the male connector 1 has a substantially rectangular insulating housing (hereafter referred to simply as a "housing") 2 which has contacts 6 (a portion of the arrangement of these contacts is shown in FIG. 3), a metal shielding shell (hereafter referred to simply as a "shell") 4 which is mounted on the outside of the housing 2 so that it covers the housing 2, and an enclosure 8 which covers approximately the rear half of this shielding shell 4. For this embodiment, the side of the male connector 1 on which the engaging part 11 is located will be referred to as the "front," and the opposite side, i.e. the side on which the cable 12 is located, will be referred to as the "rear."

The housing 2 has a rectangular flange 10 on the front part of the housing 2. A main body 16 is integrally formed rearward from this flange 10. The main body 16 has a shoulder 14 around its entire periphery. Projections 28 are caused to protrude from both sides of the housing 2 on the side facing the viewer from the plane of the paper in FIG. 1 and on the opposite side, in positions located near both end portions of the outside of the main body. The shoulder 14 is formed so that this shoulder 14 has substantially the same dimensions as the thickness of the shell 4. A plurality of slots 13 which extend forward from the shoulder 14 are respectively formed in the flange 10 on the side facing the viewer from the plane of the paper in FIG. 1 and on the opposite side. The main body 16 is accommodated inside the tip end portion of the shell 4. The flange 10 contacts the tip end 18 of the shell 4 and protrudes from this tip end 18.

As is shown most clearly in FIG. 3, a rectangular opening 20 is formed facing rearward in the flange 10 of the housing 2. A pair of ribs 22, which extend in the direction perpendicular to the direction of insertion of the male connector 1, are caused to protrude from the inside surface of this opening 20 so that these ribs 22 face each other at a roughly intermediate point with respect to the width of the housing 2 in the direction of insertion. A slot 24 is formed between these ribs. A board 26 on which numerous contacts 6 are disposed is inserted and held in this slot 24. Accordingly, the tip end portions of the contacts 6 are exposed inside the opening 20, thus forming contact parts that contact the contacts 140 of the mating connector, i.e. the female connector 100 (described later, see FIG. 6). The respective contacts 6 are connected to the conductors of individual electrical wires (not shown in the figures) of the cable 12.

The shell 4 is constructed from a set of rectangular shell half-bodies (hereafter referred to simply as "half-bodies") 4*a* and 4*b* which are combined with each other. The half-bodies 4*a* and 4*b* have similar shapes, and are constructed so that the half-body 4*a* constituting the upper side in FIG. 2 substantially covers the half-body 4*b* constituting the lower side. Tongue parts 15 (FIG. 1) are caused to protrude from the tip end 18 of the shell 4 in positions corresponding to the slots 13 in the flange 10. The tongue parts and slots engage with each other when the shell 4 is assembled with the flange 10. Bent extension parts 32 which extend rearward are formed on the rear ends 30 of the respective half-bodies 4*a* and 4*b* (FIG. 1). When the half-bodies 4*a* and 4*b* are assembled, these bent extension parts 32 act in conjunction to form a cylindrical shape in which the cable 12 is passed through. Holes 34 are formed in the half-bodies 4*a* and 4*b* in positions corresponding to the projections 28 on the above-mentioned housing 2, and these holes 34 engage with the projections 28 when the housing 2 is accommodated, so that positioning with the housing 2 is accomplished. Furthermore, recessed parts 38 (FIG. 2) which are separated from each other in the forward-rearward direction are formed by stamping in both side surfaces 36 of the half-body 4*a* so that these recessed parts 38 protrude to the inside of the half-body 4*a*. Moreover, holes (not shown in the figures) are formed in the lower-side half-body 4*b* in positions corresponding to these recessed parts 38. The recessed parts and holes engage in an interlocking engagement at the time of assembly, so that the half-bodies are fastened into an integral unit.

In the upper-side half-body 4*a*, fastening parts 40 and protruding parts 42 are formed by stamping on both sides of the central axial line of the half-body 4*a* on the front end 18 and rear part of the half-body 4*a*. The shape of the fastening parts 40 is substantially rectangular, and slits 40*a* are respectively formed in the facing inside surfaces of these fastening parts 40. Continuous L-shaped slits 42*a* which extend forward from the facing inside surfaces are formed in the protruding parts 42 on the rear part of the upper-side half-body 4*a*. A metal latching arm 44 is disposed in these fastening parts 40 and protruding parts 42.

This latching arm 44 will be described with reference to FIG. 4 as well. The latching arm 44 is formed as an integral unit by stamping and bending from a single metal plate. As is shown most clearly in FIG. 4(B), the latching arm has the approximate shape of a shallow inverted V as seen in the side view. The latching arm 44 has a long, slender plate-form base part 46 and fastening tongue parts 48 which extend in the lateral direction, i.e. in the direction perpendicular to the direction of the longitudinal axis of the base part 46. The tongue parts 48 protrude from both sides of the front end of this base part 46 via neck parts 50. As is shown most clearly in FIG. 4(C), the tip end portions of the fastening tongue parts 48 are formed with step parts, so that each fastening tongue part 48 is on the same plane as the other fastening tongue part 48. A rectangular engaging hole 54 (first engaging part) is formed at an intermediate point in the area extending from the front-end part to the apex 46*a* of the base part 46, in a position that is located slightly closer to the apex 46*a* than to the front-end part. The engaging hole 54 engages with the anchoring projection 170 of the female connector 100 (described later), so that the connectors are locked to each other.

The rear-end 56 of the base part 46 is bent downward, and is then further extended rearward, so that a holding part 60 is formed. This latching arm 44 is fastened in place by the respective insertion of the fastening tongue parts 48 on both sides into the slits 40*a* of the fastening parts 40 of the half-body 4*a*. As a result, electrical continuity is established between the latching arm 44 and the shell 4. Furthermore, the holding part 60 is held so that it can slide in the slits 42*a* of the protruding parts 42. This is done so that a smooth locking operation can be performed by the movement of the holding part 60 inside the slits 42*a* when the latching arm 44 is pressed. This holding part 60 is formed with the same width as the base part 46; however, it would also be possible to form this holding part 60 with a narrower width and to form slits with a narrower width in corresponding positions of the half-body 4*a*, so that the holding part can be inserted into these slits.

The enclosure 8 (as best shown in FIG. 2) is constructed from an upper-side enclosure half-body 8*a* (hereafter referred to simply as the "half-body 8*a*") and a lower-side enclosure half-body 8*b* (hereafter referred to simply as the "half-body 8*b*"). The respective half-bodies 8*a* and 8*b* are molded as integral units from a synthetic resin. Cable accommodating parts 64 and 65 which have a rectangular shape as seen in a FIG. 1, and which protrude outward in order to allow accommodation of the cable 12, are formed in the respective rear parts of the half-bodies 8*a* and 8*b*. The rear parts are formed with a narrow width so that these parts are constrained inward. A rectangular cut-out 66 which extends in the direction of insertion is formed in the central portion of the front part of the upper-side half-body 8*a*. The width of the cut-out 66, i.e. that gap between the opposite end edges 66*a*, is formed so that this gap is wider than the width of the above-mentioned latching arm 44.

A finger-catch part 68 which extends over the rearward-facing surface 62 of the latching arm is integrally formed on the front-end surface 64*a* of the cable accommodating part 64. Three projecting ribs 70 which are used to prevent slipping and which extend in the direction perpendicular to the direction of longitudinal axis are disposed on the finger-catch part 68. When this finger-catch part 68 is pressed with the fingers, this part pivots about the fixed end, i.e. the attachment part 72 that effects attachment to the front-end surface 64*a* of the cable accommodating part 64. Accordingly, the rearward-facing surface 62 of the latching arm, i.e. the pressing part, can be pressed via this finger-catch part 68. As a result, the position of the engaging hole 54 can be lowered, so that the engagement of the connectors to each other can be released.

Referring to FIG. 2, the half-body 8*a* has engaging arms 76 that have openings 76*a* on the side surfaces 74 of the half-body 8*a*. The half-body 8*b* has latching projections 78 in positions corresponding to the engaging arms 76. When both half-bodies 8*a* and 8*b* are assembled, the openings 76*a* in the engaging arms 76 and the latching projections 78 engage with each other, so that the half-bodies are anchored to each other. Grooves (not shown in the figures) are formed in the inside surfaces of the side surfaces 74 of the half-body 8*a* in a direction perpendicular to the direction of insertion. Tongue parts (not shown in the figures) corresponding to these grooves are formed on the half-body 4*a*. At the time of assembly, the grooves and tongue parts engage with each other, so that mutual positioning of the shell 4 and enclosure 8 is accomplished.

Figure 9:
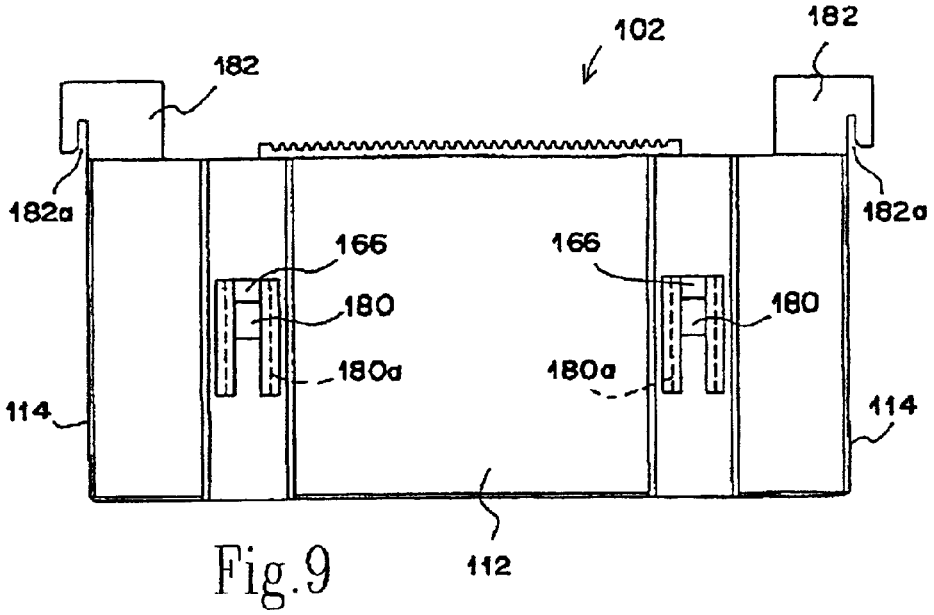
FIG. 9 is a plan view of the housing of the female connector.
Figure 10:
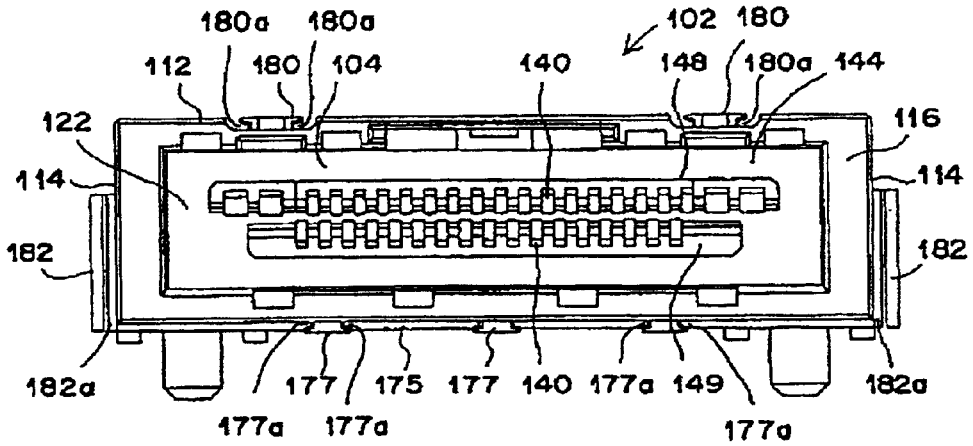
FIG. 10 is a front view of the housing of the female connector.

The female connector which engages with the male connector 1 to form the electrical connector assembly of the present invention will be described with reference to FIGS. 5 through 10. FIGS. 5, 6, 7, and 8 are respectively a plan view, front view, side view, and bottom view of the female connector. FIGS. 9 and 10 are respectively a plan view and a front view of the housing of the female connector shown in FIG. 5.

The following description will refer to FIGS. 5 through 10. As is shown most clearly in FIGS. 9 and 10, the insulating housing (hereafter referred to simply as a "housing") 102 of the female connector 100 is molded from an insulating resin, and has a shape which is substantially that of a rectangular solid. A rectangular opening 122 whose length runs in the lateral direction is formed in the front surface 116 of the housing 102. An engaging recess 104 is formed into the interior of the housing 102 from the opening 122. As is shown most clearly in FIGS. 6 and 10, two plates, i.e. upper and lower plates 148 and 149, which extend in the lateral direction are disposed in close proximity to each other in the approximate center of the engaging recess 104, and are caused to protrude from the rear wall 144 of the engaging recess 104 in the direction perpendicular to the plane of the page in FIGS. 6 and 10. The upper plate 148 is slightly longer than the lower plate 149. A plurality of contacts 140 are disposed at specified intervals on the respective plates 148 and 149 along the direction of length of the plates, so that the contacts 140 on each plate face the other plate. Two contacts each for power supply use are disposed on both end portions of the upper plate 148.

A metal shielding shell (hereafter referred to simply as a "shell") 106 which has a shape similar to that of the housing 102 and which is used for electromagnetic shielding is mounted on the outside of the housing 102. The shell 106 is formed by stamping and bending a single metal plate, and has a top wall 130 which covers the upper wall 112 and side walls 114 of the housing 102, side walls 108, and a face plate 120 which covers the front surface 116 of the housing 102. Ground connection to the ground conductors of the attachment board (not shown in the figures) is accomplished by means of tongue parts 110 which drop from the respective side walls 108 of the shell 106. Tongue parts 132 (described later) also project from shell 106.

Figure 5:
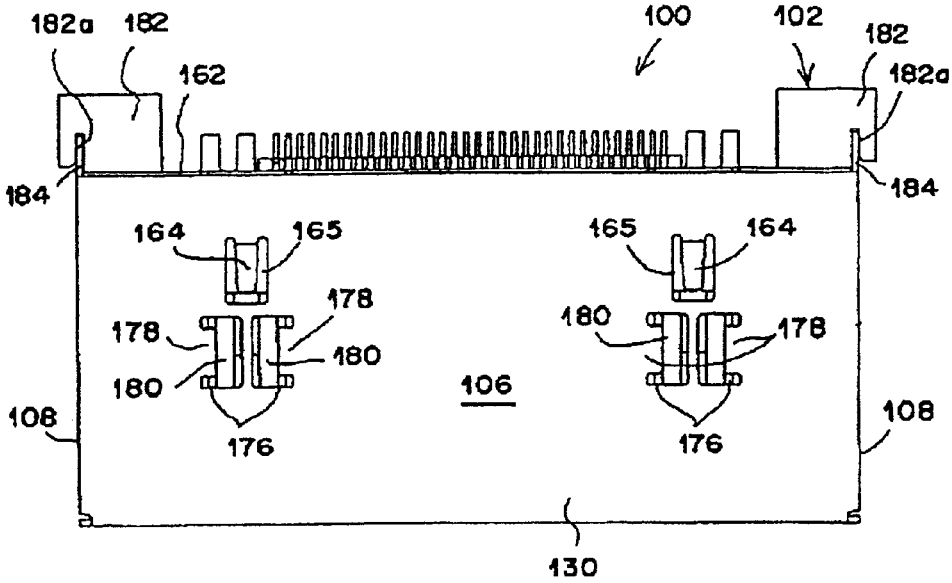
FIG. 5 is a plan view of the female connector.

Referring to FIG. 5, latching arms 164 are formed in the top wall 130 of the shell 106 on the left and right sides near the rear end 162 of the shell 106. The latch arms 164 face forward and are inclined toward the housing 102 and inside openings 165. When the housing 102 is inserted into the shell 106 from the rear end 162 of the shell 106, these latching arms 164 act in conjunction with projections 166 (FIG. 9) on the upper wall 112 of the housing 102, so that the housing 102 is prevented from slipping out to the rear.

Blocks 182 which have a rectangular configuration protrude from both sides of the rear part of the housing 102 as integral parts of the housing 102. Tab grooves 182*a* which accommodate rear tabs 184 (FIG. 5) that protrude from the rear end 162 of the shell 106 are formed on the blocks 182. When the housing 102 is mounted in the shell 106, the rear tabs 184 enter the tab grooves 182*a*, so that movement of the housing 102 in the forward direction is prevented.

Tongue parts 178 formed by C-shaped slots 176 are disposed in pairs facing each other in the top wall 130 of the shell 106 near the latching arms 164. Projections 180, with a T-shaped cross section, are formed on the upper wall 112 of the housing 102 in positions corresponding to the tongue parts 178. Projections 180 have grooves 180*a* proved therein. The tongue parts 178 are anchored by being inserted into the grooves 180*a* of these projections 180 from both sides. As a result, the top wall 130 of the shell 106 is prevented from floating upward from the upper wall 112 of the housing 102.

Figure 6:
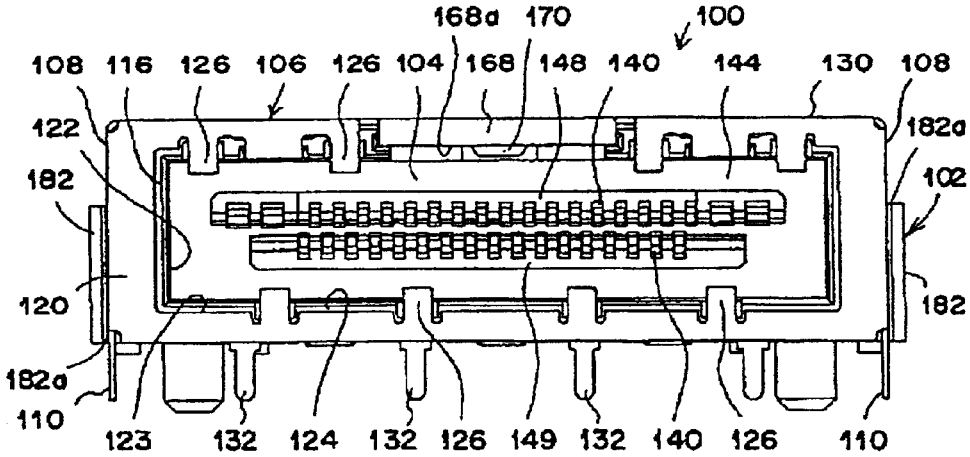
FIG. 6 is a front view of the female connector shown in FIG. 5.
Figure 7:
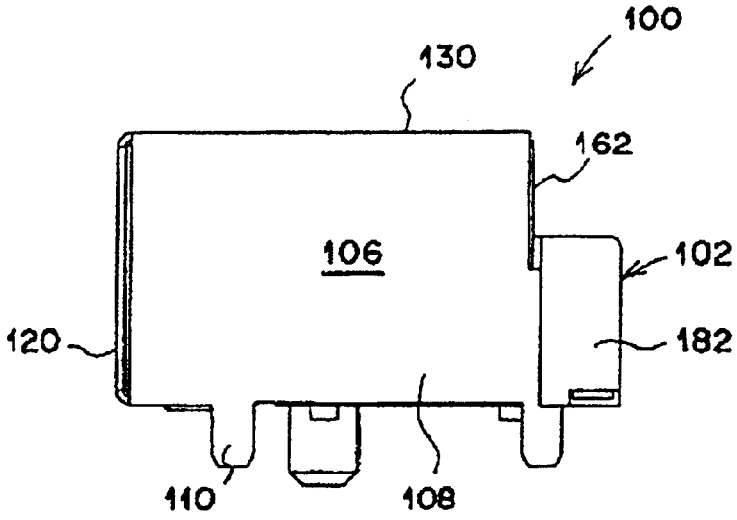
FIG. 7 is a side view of the female connector shown in FIG. 6.
Figure 8:
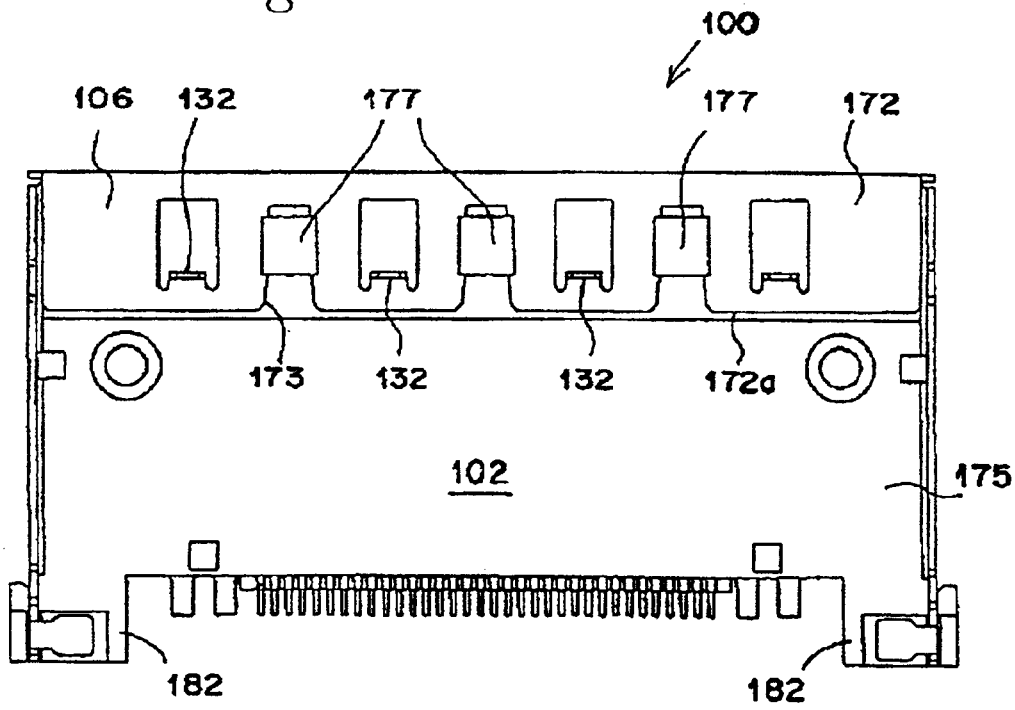
FIG. 8 is a bottom view of the female connector.

Tongue parts 132, as best shown in FIGS. 6 and 8, are formed by being cut and raised from a bent part 172 that is folded over the undersurface of the housing 102 from the lower part of the face plate 120. The respective tongue parts 132 are disposed in positions near the lower-side spring contact parts 126. These tongue parts 132 form a grounding path that extends from the lower-side spring contact parts 126 to the board.

As is shown most clearly in FIG. 8, cut-outs 173 are formed from the rear-end 172*a* of the bent part 172. These cut-outs 173 engage with grooves 177*a* (FIG. 10) formed in T-shaped projections 177 that are caused to protrude from the bottom surface 175 of the housing 102, so that the bent part 172 is anchored to the bottom surface 175 of the housing 102.

Referring to FIG. 6, an opening 123 is formed on the inside of the face plate 120 in a position corresponding to the above-mentioned engaging recess 104. Spring contact parts 126 are formed by being bent from the upper and lower inside edges 124 of the opening 123 at specified intervals so that these spring contact parts 126 enter the interior of the engaging recess 104. On the lower side, four spring contact parts 126 are formed at substantially equal intervals, while on the upper side, two spring contact parts each are formed in positions located closer to both ends of the opening 123. Between the two spring contact parts 126 positioned to the inside on the upper side, an inside extension part 168 which extends into the interior of the engaging recess 104 is formed by being bent from the top wall 130 of the shell 106 at the front surface 116 of the housing 102. An anchoring projection 170 is caused to protrude into the interior of the engaging recess 104 from the inside surface 168*a* of the inside extension part 168. This anchoring projection 170 forms a locking part that engages with the engaging hole 54 of the latching arm 44 of the male connector 1 at the time of engagement with the male connector 1, thus maintaining the connectors in a mutually engaged state. The anchoring projection 170 has electrical continuity with the shell 106, and the engaging hole 54 of the latching arm 44 of the male connector that engages with the anchoring projection 170 also has electrical continuity with the shell 4 of the male connector 1. Accordingly, when the female connector 100 is engaged with the male connector 1 by the spring contact parts 126 and the locking part, contact is made with the shell 4 of the male connector 1, so that an integral shield is formed between the two connectors 1 and 100.

The lower-side spring contact parts 126 are disposed at equal intervals, while the upper-side spring contact parts 126 have a large intermediate space. However, since the anchoring projection 170 constitutes a contact part of the shield in the same manner as the spring contact parts 126, the spacing between the contact parts is substantially the same in both cases. In this case, the portions of the shell 4 of the male connector 1 that contact the spring contact parts 126, i.e. the contact surfaces of the shell 4, constitute contact parts. Accordingly, the contact between the shell 4 and the shell 106 is accomplished via contact parts that are disposed at the same intervals, so that there is no drop in the shielding performance. Furthermore, since the size of the locking part is extremely small and since the latching arm 44 is accommodated inside the female connector 100, the electrical connector assembly can also be made compact.

In the embodiment described, an engaging hole 54 was formed in the latching arm 44, and an anchoring projection 170 was formed on the shielding shell 106 of the female connector 100. However, the reverse construction could also be used. Specifically, it would also be possible to form an anchoring projection on the latching arm 44 and to form an engaging hole in the shielding shell.

We claim:

1. An electrical connector comprising:

an insulating housing that holds contacts, a shielding shell that is externally mounted on the insulating housing, and a conductive latching arm that is disposed on an outside of the shielding shell for engagement with a mating connector, the latching arm having a front end fastened to an end portion of the shielding shell, and a rear end positioned adjacent to a surface of the shielding shell so that the rear end can slide on the surface of the shielding shell, the latching arm has an engaging part which is located near the front end of the latching arm, the engaging part cooperates with a mating engaging part of the mating connector, the latching arm has a pressing part which is located on a rear part of the latching arm, and the shielding shell includes protruding parts formed to hold the rear end of the latching arm adjacent to the surface of the shielding shell.

2. The electrical connector as recited in claim 1, wherein the latching arm has a shallow inverted v-shape.

3. The electrical connector as recited in claim 2, wherein the engaging part of the latching arm has an engaging hole that is formed in a forward-facing surface of the latching arm.

4. The electrical connector as recited in claim 3, wherein the pressing part is located on a rearward-facing surface of the latching arm, the pressing part is inclined toward the rear end of the latching arm.

5. The electrical connector as recited in claim 4, wherein a covering enclosure is formed on the outside of the shielding shell with an end portion of the shielding shell being exposed, the covering enclosure has finger-catch part on the rearward-facing surface that is engageable to push the rearward-facing surface.

6. The electrical connector as recited in claim 1, wherein the front end of the latching arm includes tongue parts protruding from both sides of the front end.

7. An electrical connector comprising:

an insulating housing having contacts, a shielding shell externally mounted on the insulating housing, a conductive latching arm disposed on an outside surface of the shielding shell, the latching arm having a front end fastened to the shielding shell and a rear end arranged on the outside surface of the shielding shell such that the rear end slides on the outside surface, the latching arm having an engaging part which is located near the front end of the latching arm, the engaging part cooperates with a mating engaging part of a mating connector, the latching arm has a pressing part which is located on the rear part of the latching arm, and a covering enclosure is formed on the outside of the shielding shell, the covering enclosure having a finger-catch part that is engageable to push the pressing part to release the mating engaging part from the engaging part.

8. The electrical connector as recited in claim 7, wherein the latching arm has a shallow inverted v-shape.

9. The electrical connector as recited in claim 7, wherein the front end of the latching arm includes tongue parts protruding from both sides of the front end.

10. The electrical connector as recited in claim 7, wherein the shielding shell includes protruding parts formed to hold the rear end of the latching arm adjacent to the outside surface of the shielding shell.

* * * * *